US011703010B2

(12) United States Patent
Revidat et al.

(10) Patent No.: US 11,703,010 B2
(45) Date of Patent: Jul. 18, 2023

(54) ELECTRONIC CONTROL UNIT AND FUEL TYPE ANALYSIS METHOD

(71) Applicants: Hyundai Motor Company, Seoul (KR); Kia Corporation, Seoul (KR)

(72) Inventors: Stephan Revidat, Langen (DE); Leigh Deissenroth, Mainz (DE)

(73) Assignees: Hyundai Motor Company, Seoul (KR); Kia Corporation, Seoul (KR)

( * ) Notice: Subject to any disclaimer, the term of this patent is extended or adjusted under 35 U.S.C. 154(b) by 158 days.

(21) Appl. No.: 17/322,499

(22) Filed: May 17, 2021

(65) Prior Publication Data

US 2022/0290627 A1 Sep. 15, 2022

(30) Foreign Application Priority Data

Mar. 12, 2021 (DE) ..... 102021202445.9

(51) Int. Cl.

| | |
|---|---|
| ***F02D 41/26*** | (2006.01) |
| ***F02D 41/38*** | (2006.01) |
| ***F02D 19/06*** | (2006.01) |
| ***F02D 41/24*** | (2006.01) |
| ***F02D 41/14*** | (2006.01) |

(52) U.S. Cl.

CPC ..... *F02D 41/263* (2013.01); *F02D 19/0628* (2013.01); *F02D 41/1405* (2013.01); *F02D 41/2422* (2013.01); *F02D 41/2441* (2013.01); *F02D 41/38* (2013.01); *F02D 2200/0611* (2013.01)

(58) Field of Classification Search

CPC ..... F02D 19/0628; F02D 41/1405; F02D 41/2422; F02D 41/2441; F02D 41/263; F02D 41/38; F02D 2200/0611

See application file for complete search history.

(56) References Cited

U.S. PATENT DOCUMENTS

| | | | | |
|---|---|---|---|---|
| 7,657,363 | B2 * | 2/2010 | Cheiky | F02M 27/02 123/549 |
| 2009/0114288 | A1 * | 5/2009 | Grant | F02D 19/0665 137/88 |
| 2019/0093588 | A1 | 3/2019 | Schaub et al. | |

FOREIGN PATENT DOCUMENTS

| | | | |
|---|---|---|---|
| DE | 102018123262 | A1 | 11/2018 |
| DE | 102017216973 | A1 | 3/2019 |
| DE | 102018104258 | A1 | 8/2019 |

* cited by examiner

*Primary Examiner* — Hung Q Nguyen
*Assistant Examiner* — Mark L. Greene
(74) *Attorney, Agent, or Firm* — Fox Rothschild LLP

(57) ABSTRACT

An electronic control unit for a vehicle with a combustion engine and a method of fuel analysis are provided. At least one dynamic torque sensor value from a high pressure pump of the vehicle and at least one additional sensor value including at least one pressure sensor value and/or at least one timing value are used to determine whether a combustible fuel type currently in use is known, unknown, or similar to a known fuel type. In each case, the operation of the combustion engine is optimized using specific parameter configurations for the fuel injectors of the vehicle. The specific parameter configurations are either retrieved from a database, or are generated using artificial intelligence methods.

11 Claims, 8 Drawing Sheets

ELECTRONIC CONTROL UNIT AND FUEL TYPE ANALYSIS METHOD

CROSS-REFERENCE TO RELATED APPLICATION(S)

This application is based on and claims priority under 35 U.S.C. § 119 to German Patent Application No. 102021202445.9, filed on Mar. 12, 2021, the disclosure of which is incorporated by reference herein in its entirety.

FIELD OF THE INVENTION

The present invention relates to an electronic control unit, a method for fuel type analysis, and to a method of operating a combustion engine of a vehicle based on the fuel type analysis.

BACKGROUND

Direct fuel injection equipment for gasoline as well as diesel fuel lead as one major driver to clean combustion. But nowadays, fuels are changing in content and type to change today's fossil fuels to a next generation of carbon-neutral fuels. The parameters for controlling not only the hardware, but increasingly also the software of a vehicle with a combustion engine can in principle be optimized for different types of fuels. By an accurate optimization (or: engine system calibration), efficiency of the combustion may be enhanced substantially. In particular, the hardware benefits from being run with optimized parameters, and also fuel consumption may be reduced.

Different types of fuels in this context may include different chemical compounds or mixtures, different types of fluids (liquids or gases) and so on. Differences in fuel types may be as large as between a type of e-fuel and fossil fuel, or may be as small as local variations of essentially the same fuel, for example due to impurities or varying contents of admixtures in a particular fuel station.

Attempts to optimize the operation of the combustion require determining, in each vehicle, which type of fuel is currently powering the engine. In the prior art, fuel sensors are provided which determine chemical compounds, usually carbon and hydrogen, using light refraction. However, such determinations may not be unique and cannot account well for optically similar but chemically different fuel types. Moreover, even when two different fuel types are able to be precisely distinguished, in the prior art the capacity to respond to a particular fuel type is limited.

DISCLOSURE OF THE INVENTION

An object of the present invention is to overcome the above described problems in the prior art, and to provide an electronic control unit which is capable of more accurately distinguishing different fuel types from one another and capable of suitably reacting to the different fuel types to provide a suitable combustion operation in the combustion engine, even if the fuel type has been previously unknown.

Accordingly, a further object of the invention is to provide methods for more accurately determining fuel types, and for operating combustion engines suitably based on a determined fuel type, even if the fuel type has been previously unknown.

The invention provides an electronic control unit (ECU) for a vehicle with a combustion engine, comprising at least an input interface and a computing unit. The input interface may be configured to receive at least one dynamic torque sensor value from a high pressure pump of the vehicle; receive at least one additional sensor value including at least one pressure sensor value and/or at least one timing value; to receive combustion performance data indicating combustion properties of a current fuel type of a fuel currently present in the high pressure pump and the fuel rail; and to grant access to a database containing information about known fuel types; and a specific parameter configuration for fuel injectors operatively (and fluidly) connected to the fuel rail, for each of the known fuel types.

The at least one additional sensor value may be at least one sensor value allowing a calculation of the speed of sound within the fuel; for example, simultaneous rail sensor values from two or more rail pressure sensors, or a timing value for a time between a pressure-changing event and its effect at a rail pressure sensor may be used.

Sufficient data about the properties of any type of combustible fuel may be determined using the dynamic torque sensor value and the at least one additional sensor value. Accordingly, artificial intelligence entities (e.g., artificial neural networks) may be used to provide optimized parameter configurations (e.g. optimized injection waveforms) for the determined fuel types.

It shall be understood that whenever herein mention is made of sensor values (e.g. the dynamic torque sensor value or the at least one additional sensor value), these may include a single measuring or a plurality of measurements for the values. In other words, a characteristic curve for each sensor value may be generated and utilized. Such curves may include at least four data points and generally profit if the number of data points is higher than that. For example, several measurements at different rail pressure values may be made, e.g. from 200 bar to 1000 bar in 100-bar steps. The combustion performance data indicating the combustion properties of the current fuel type of the fuel currently present in the high pressure pump, fuel rail and engine, may be provided by one or more cylinder pressure sensors which measure corresponding pressures in cylinders of the combustion engine.

The database may be part of the electronic control unit, in which case the input interface may be operatively connected to an internal memory storing the database. Alternatively or additionally, the database may be provided by a central server, for example a cloud server, i.e. the database may be a cloud-based database. In that case, the input interface may include a transceiver configured to communicate with the database via a suitable network such as the Internet and/or the like.

The database contains at least information about known fuel types and a specific parameter configuration for the fuel rail for each of the known fuel types. Such parameter configurations may, for example, include timings and/or amounts for fuel injections into one or more cylinders of the combustion engine. Such timings and/or amounts may be collectively designated as an "injection waveform".

The computing unit may be configured to implement: a fuel type detection module; an artificial intelligence module; and a fuel injection control module. The computing unit may include at least one central processing unit (CPU), a working memory (random access memory, RAM), and a non-volatile memory, all operatively coupled. The computing unit may alternatively, or additionally, to the CPU also include at least one graphics processing unit (GPU), at least one field programmable gate array (FPGA), at least one application-specific integrated circuit (ASIC) and/or the like.

Each individual module may be realized in software and/or hardware. The distinction of different modules is mainly made for ease of explanation; in reality, all of the modules may be implemented by one single set of programming instructions executed by the computing unit, wherein the modules may e.g. be realized by separate (or even partially overlapping) functions or sub-routines. However, for additional optimization, any or all of the modules may be realized as specifically developed hardware pieces with specific coding therefore, in particular in case of the artificial intelligence module.

The fuel type detection module may be configured to determine, based on the at least one received dynamic torque sensor value and on the received at least one additional sensor value (and preferably using the database), whether the current fuel type is of: a first fuel type group including the known fuel types (i.e. a known fuel type); a second fuel type comprising fuel types within a predefined variation range about at least one fuel type of the first fuel type group (i.e. a fuel type similar to a known fuel type); a third fuel type group comprising all other fuel types (i.e. a completely unknown fuel type).

The fuel injection control module may be configured to, in response to determining that the current fuel type is of the first fuel type group, generate control signals for fuel injectors of the combustion engine using the specific parameter configuration (e.g. injection waveform) for the current fuel type from the database. The fuel injection control module may be configured to, in response to determining that the current fuel type is the third fuel type group, generate control signals for the fuel injectors initially using a fallback parameter configuration.

The artificial intelligence module may be configured to, in response to determining that the current fuel type is the third fuel type group, implement and train a new fuel type parameter artificial neural network for determining a specific parameter configuration for the current fuel type. Thus, when the current fuel type is known (e.g., first fuel type group), a known specific parameter configuration is used, and when the current fuel type is unknown, a new specific parameter configuration may be generated. This allows a large variety of fuel types to be used with one specific vehicle, even accounting for variations, unknown fuel types, unforeseen additives or degradations and so on.

Thus, to be prepared for a likely future market situation of different fuel types and variety of blends, a method combining fuel type determination, combustion analysis and self-learning/adopting logic is provided hereby. Therefore, in particular the combination of a novel fuel type identifying approach by high pressure pump based drive torque dynamic analysis in combination with self-learning neural networks and combustion analysis as feedback allows a total preparation of the engine for even today unknown fuel mixtures.

The invention also provides a vehicle comprising the electronic control unit according to the present invention, and may in addition comprise any of the devices which provide data to, or receive data (in particular control signals) from the electronic control unit, such as the fuel injectors, the combustion engine, the high pressure pump, a navigation system, or various internal and/or external sensors.

The invention also provides a method for fuel type analysis, comprising: receiving at least one dynamic torque sensor value from a high pressure pump of the vehicle; receiving at least one additional sensor value from a fuel rail of the vehicle, the at least one additional sensor value including at least one pressure sensor value and/or at least one timing value; receiving combustion performance data indicating combustion properties of a current fuel type of a fuel currently present in the high pressure pump and the fuel rail and being currently provided to a combustion engine of the vehicle; determining, based on the at least one received dynamic torque sensor value and the received at least one additional sensor value, whether the current fuel type is of a first fuel type group including the known fuel types; a second fuel type including fuel types within a predefined variation range about at least one fuel type of the first fuel type group; a third fuel type group including all other fuel types.

The invention further provides a method for operating a combustion engine of a vehicle, comprising: determining (e.g. by a by a fuel type determination module) whether a current fuel type of a fuel currently present in a high pressure pump of the vehicle and a fuel rail of the vehicle and being currently provided to the combustion engine is of the first fuel type group, the second fuel type group or the third fuel type group according to any embodiment of the previously recited method for fuel type analysis. When the current fuel type is determined to be of the first fuel type group, the method further includes: generating control signals for fuel injectors of the vehicle using a specific parameter configuration for the current fuel type from the database. When the current fuel type is determined by the fuel type determination module to be of the third fuel type group, the method further includes: generating the control signals for the fuel injectors initially using a fallback parameter configuration; and implementing and training a new fuel type parameter artificial neural network for determining a specific parameter configuration for the current fuel type, wherein the training is preferably performed via reinforcement learning.

Further advantageous exemplary embodiments, variants and refinements are presented in the dependent claims as well as in the description with reference to the figures. It shall be understood that every variant or option or modification that is described with respect to any embodiment of the electronic control unit or of the vehicle according to the present invention may equally be applied to, or realized in, any embodiment of the methods according to the present invention, and vice versa.

In some advantageous embodiments, refinements, or variants of embodiments, the artificial intelligence module is further configured to implement a combustion performance evaluation artificial neural network configured to receive at least the combustion performance data and to determine, based at least thereon, whether the operation of the combustion engine is currently acceptable in view of the current fuel type.

Specifically, "acceptable" may in this context mean that a combustion waveform exhibited by the combustion of the current fuel in the combustion engine lies within a predefined relationship to a desired (or: optimal) corridor for the combustion waveform, for example completely therein, mostly therein, close to a center line thereof and/or the like. In this way, even for previously unknown fuel types a measure can be provided whether combustion is performed within suitable parameters or whether there might be a kind of engine malfunction or the like.

The electronic control unit may further include an output interface configured to provide a combustion performance evaluation signal based on the output of the combustion performance evaluation artificial neural network. The combustion performance evaluation signal may in particular be provided to an on-board diagnosis system of the vehicle, e.g. turning a malfunction indicator lamp (MIL) of the vehicle on (fault signal). Other applications of the combustion performance evaluation signal are possible as well.

In some exemplary embodiments, refinements, or variants of embodiments, the electronic control unit (ECU) is such that, when the current fuel type is determined to be of the third fuel type group: the artificial intelligence module is configured to train the new fuel type parameter artificial neural network using reinforcement learning based on the received combustion performance data, and the fuel injection control module is configured to generate the control signals based on an output of the new fuel type parameter artificial neural network during its training, i.e. during training of the new fuel type parameter artificial neural network.

In other words, the artificial intelligence module and the fuel injection control module are configured to perform these method steps in response to determining that the current fuel type is the third fuel type group. Accordingly, specific parameter configurations (or, in other words, specific injection waveforms) for previously unknown fuel types may be generated. This allows the vehicle user to put a large variety of fuel types in the fuel tank of their vehicle, knowing that over the training period an efficient injection waveform (leading to a desired combustion waveform) will be found.

In some exemplary embodiments, refinements, or variants of embodiments, the artificial intelligence module is configured to stop the training of the new fuel type parameter artificial neural network when a stopping condition is fulfilled. For example, such a stopping condition may be a desired congruity of the current combustion waveform with a desired corridor for the combustion waveform (e.g. the entire current combustion waveform must be inside the desired corridor), or a deviation of the combustion waveform from a center curve of the desired corridor must be below a predefined threshold according to a deviation metric (e.g. squared error metric).

Thereafter the specific parameter configuration for the current fuel type of the third fuel type group may be set based on the output of the trained new fuel type parameter artificial neural network, and the current fuel type is added to the first fuel type group. This may be performed by adding the current fuel type to the database comprising the known fuel types (first fuel type group).

Additional information such as the newly determined specific parameter configuration for the current fuel type and the like may also be added to the database. Accordingly, the knowledge about fuel types and their specific parameter configurations is expanded, and when the same fuel type is used again, the next time it will not be classified into the third fuel type group but into the first fuel type group. This provides a smoother combustion operation in the future as well as reduced required computing power.

In some exemplary embodiments, refinements, or variants of embodiments, the artificial intelligence module is further configured to implement and train a new combustion performance evaluation artificial neural network for determining whether the operation of the combustion engine using the current fuel type and using the control signals based on the output of the is acceptable. The artificial intelligence module is further configured to replace the previous combustion performance evaluation artificial neural network with the new combustion performance evaluation artificial neural network while the current fuel type of the third fuel type group is used when a replacement condition is fulfilled.

In case of a change of fuel type, this change may be reversed again. The database may include, for each (or at least for some) of the known fuel types also a fully trained combustion performance evaluation artificial neural network which may be deployed, instead of the currently deployed one, whenever a new known fuel type is determined. Accordingly, the evaluation of the combustion using the combustion performance evaluation artificial neural network is more accurately adapted to the fuel type currently in use.

In some advantageous exemplary embodiments, refinements, or variants of embodiments, the electronic control unit is further configured such that, when the current fuel type is determined to be of the second fuel type group, the fuel injection control module is configured to: select a fuel type of the first fuel type group from the database based on the at least one received dynamic torque sensor value and on the received at least one additional sensor value; and to generate the control signals using the specific parameter configuration for the selected fuel type from the database.

Accordingly, "borderline" cases in which a new fuel type is neither completely known nor completely unknown may be treated as well as possible initially, while steps are being taken to further improve the situation while the vehicle may already be operating (or at least the combustion already takes place in the combustion engine; ideally this will allow the driver of the vehicle to use the vehicle without any disadvantage).

The selected fuel type (from the first fuel type group) may be a fuel type which is most similar (using a given similarity metric) to the current fuel type in on or more properties. These properties may for example be direct sensor values such as the dynamic torque sensor value DTSV and/or the at least one additional sensor value. The properties may alternatively, or in addition, also be properties derived from sensor values such as a bulk modulus, a speed of sound, a density and/or the like of the current fuel type.

If more than one property is compared between the current fuel type and the fuel types of the first fuel type group, then each property may be equally weighted, or different weights may be applied to different properties. The selected fuel type may also be selected from the fuel types of the first fuel type group following IF-THEN type rules and/or decision trees or the like. These rules, weights, and in general selection strategies for selecting the selected fuel type may in general be selected and devised in order to ensure, or at least make more likely, that the specific parameter configurations used for the current fuel type result in a combustion within the desired corridor.

Some (or all, or none) of the selection strategies may be constant, while others (or all, or none) may depend on the current situation, for example on a current temperature, location and/or the like. The input interface may be configured to receive corresponding data, e.g. temperature data from a thermometer of the vehicle, location data from a navigation system of the vehicle and/or the like. Any or all of these data sources may be part of the vehicle provided by the present invention.

In some exemplary embodiments, refinements, or variants of embodiments, the artificial intelligence module is further configured to implement and train an adapted fuel type parameter artificial neural network for determining a specific parameter configuration for the current fuel type. Accordingly, an adapted injection waveform for the current fuel type, and according control signals for the fuel injectors may be provided, thus improving the combustion performance.

In some exemplary embodiments, refinements, or variants of embodiments, the database includes parameters for a corresponding pre-trained fuel type parameter artificial neural network for each of the fuel types of the first fuel type group, and the initial parameters for the adapted fuel type parameter artificial neural network to be trained are the parameters of the pre-trained fuel type parameter artificial neural network of the selected fuel type.

Thus, initial parameters of the adapted fuel type parameter artificial neural network to be trained are taken from a database entry of the database associated with the selected fuel type. In other words, the database may, for each known fuel type, also include a corresponding set of neural network parameters (usually weights and biases), specifically for the use as initial parameters for fuel type parameter artificial neural networks to be adapted/trained. Thus, pre-trained artificial neural networks are used, and only fine-tuning is performed when a fuel type of the second fuel type group is determined to substantially reduce necessary computing power and computing time.

In some exemplary embodiments, refinements, or variants of embodiments, the method further comprises: implementing a combustion performance evaluation artificial neural network configured to receive at least the combustion performance data and to determine, based at least thereon, whether the operation of the combustion engine is currently acceptable in view of the current fuel type; determining whether the operation of the combustion engine is currently acceptable in view of the current fuel type using the implemented performance evaluation artificial neural network; and providing a combustion performance evaluation signal based on the output of the combustion performance evaluation artificial neural network.

In some exemplary embodiments, refinements, or variants of embodiments, the method for operating the combustion engine of the vehicle further comprises, in case the current fuel type is determined to be of the third fuel type group: training the new fuel type parameter artificial neural network using reinforcement learning based on the received combustion performance data; and generating the control signals for the fuel injectors of the vehicle based on an output of the new fuel type parameter artificial neural network during its training. In particular, an output of the new fuel type parameter artificial neural network may be specific parameter configurations for an optimized injection waveform for the fuel injectors, based on which in turn the control signals may be generated to operate the fuel injectors to realize the optimized injection waveform.

Accordingly, a feedback loop is established such that for the training the changing combustion performance is taken into account to optimize the new fuel type parameter artificial neural network. After training has been stopped, final results for the specific parameter configurations may be stored (e.g. in the database) and may from then on be used for generating the control signals.

In some exemplary embodiments, refinements, or variants of embodiments, the method further comprises: stopping the training of the new fuel type parameter artificial neural network when a stopping condition is fulfilled; thereafter (i.e. after stopping) setting the specific parameter configuration for the current fuel type of the third fuel type group based on the output of the trained new fuel type parameter artificial neural network; and adding, by the electronic control unit, the current fuel type to the first fuel type group, preferably together with additional information such as the specific parameter configuration determined by the new fuel type parameter artificial neural network.

In some exemplary embodiments, refinements, or variants of embodiments, the method further comprises: implementing and training a new combustion performance evaluation artificial neural network for determining whether the operation of the combustion engine using the current fuel type and using the control signals based on the output of the new fuel type parameter artificial neural network is acceptable; and replacing the previous combustion performance evaluation artificial neural network with the new combustion performance evaluation artificial neural network while the current fuel type of the third fuel type group is used when a replacement condition is fulfilled.

In some exemplary embodiments, refinements, or variants of embodiments, the method further comprises, in case the current fuel type is determined to be of the second fuel type group: selecting a fuel type of the first fuel type group from the database based on the at least one received dynamic torque sensor value and on the received at least one additional sensor value; and generating the control signals using the specific parameter configuration for the selected fuel type from the database.

In some exemplary embodiments, refinements, or variants of embodiments, the method further comprises: implementing and training an adapted fuel type parameter artificial neural network for determining a specific parameter configuration for the current fuel type, wherein initial parameters of the adapted fuel type parameter artificial neural network to be trained are taken from a database entry of the database associated with the selected fuel type. In particular, for each know fuel type (i.e. fuel type of the first fuel type group), a set of neural network parameters for implementing a pre-trained artificial neural network may be stored in the database, so that training the adapted fuel type parameter artificial neural network may be performed by fine-tuning a corresponding pre-trained artificial neural network.

In other words, in some exemplary embodiments, refinements, or variants of embodiments, the database includes parameters for a corresponding pre-trained fuel type parameter artificial neural network for each of the fuel types of the first fuel type group, and the initial parameters for the adapted fuel type parameter artificial neural network to be trained are the parameters of the pre-trained fuel type artificial neural network of the selected fuel type.

BRIEF DESCRIPTION OF THE FIGURES

For a more complete understanding of the present invention and advantages thereof, reference is made to the following description taken in conjunction with the accompanying drawings. The invention is explained in more detail below using exemplary embodiments, which are specified in the schematic figures, in which.

Unless indicated otherwise, like reference signs to the figures indicate like elements.

DETAILED DESCRIPTION

Figure 1:
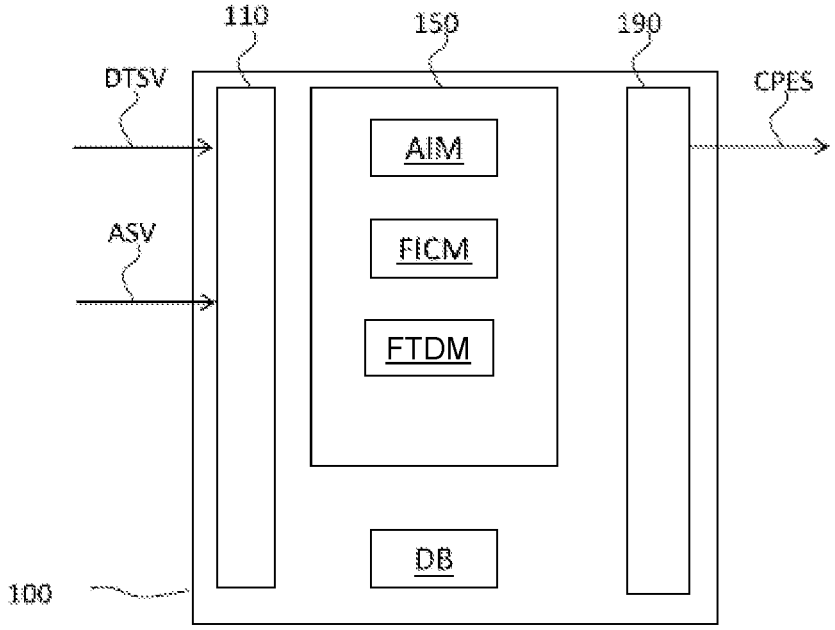
FIG. 1 shows a schematic block diagram illustrating an electronic control unit for a combustion engine of a vehicle according to an exemplary embodiment of the invention.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, combustion, plug-in hybrid electric vehicles, hydrogen-powered vehicles and other alternative fuel vehicles (e.g. fuels derived from resources other than petroleum).

Although exemplary embodiment is described as using a plurality of units to perform the exemplary process, it is understood that the exemplary processes may also be performed by one or plurality of modules. Additionally, it is understood that the term controller/control unit refers to a hardware device that includes a memory and a processor and is specifically programmed to execute the processes described herein. The memory is configured to store the modules and the processor is specifically configured to execute said modules to perform one or more processes which are described further below.

Furthermore, control logic of the present invention may be embodied as non-transitory computer readable media on a computer readable medium containing executable program instructions executed by a processor, controller/control unit or the like. Examples of the computer readable mediums include, but are not limited to, ROM, RAM, compact disc (CD)-ROMs, magnetic tapes, floppy disks, flash drives, smart cards and optical data storage devices. The computer readable recording medium can also be distributed in network coupled computer systems so that the computer readable media is stored and executed in a distributed fashion, e.g., by a telematics server or a Controller Area Network (CAN).

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about."

FIG. 1 shows a schematic block diagram illustrating an electronic control unit, ECU 100, for a combustion engine of a vehicle according to an exemplary embodiment of the invention. The ECU 100 may include an input interface 110, a computing device 150, a database DB, and optionally an output interface 190.

The input interface 110 is configured to allow the ECU 100 to receive signals (or: data represented by signals) from various sources. Such sources may be sensors, databases and/or the like. In some exemplary embodiments, one or more, or all, of such sources may be part of system which is also provided by the current invention, wherein the system also comprises the ECU 100.

Figure 2:
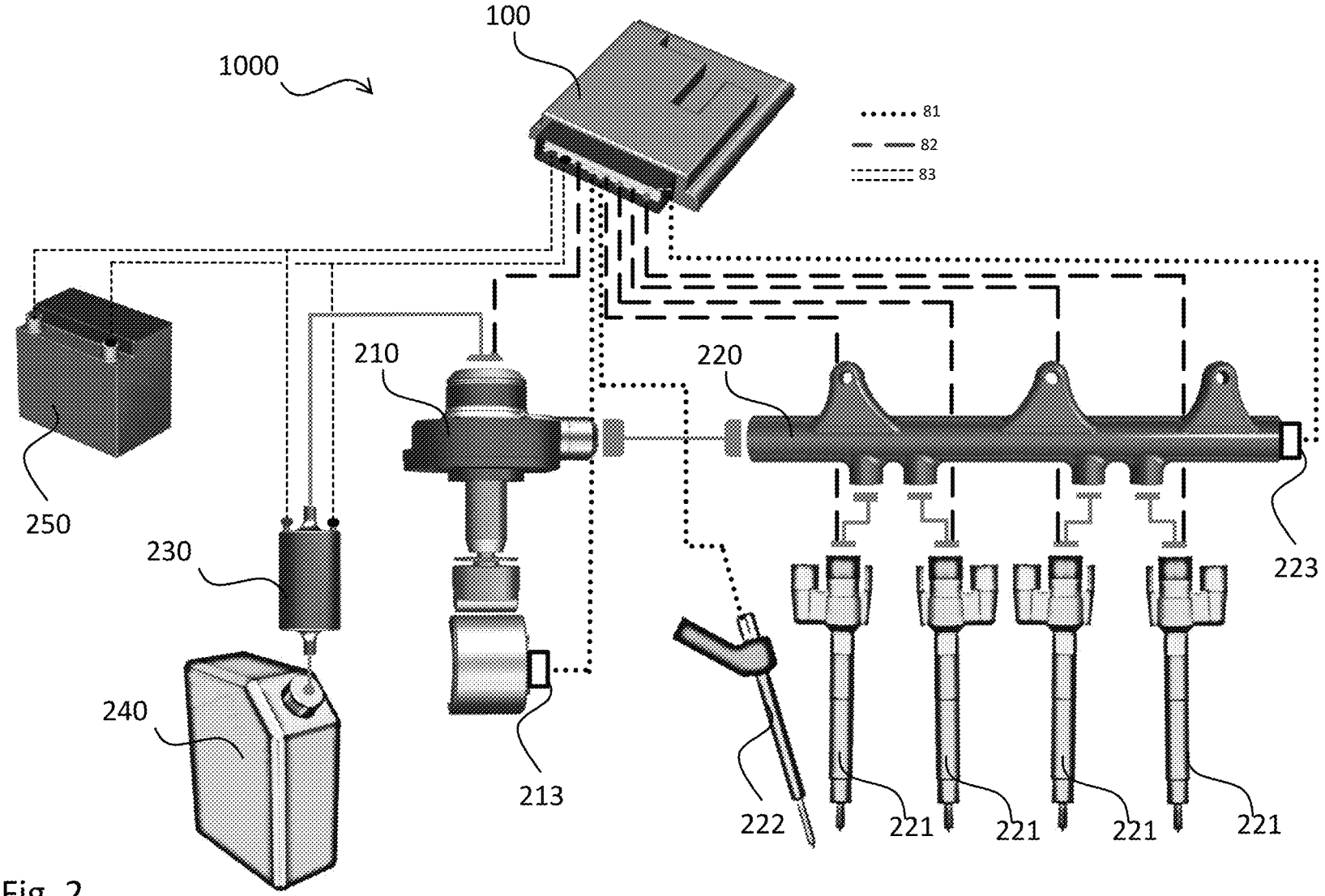
FIG. 2 schematically illustrates a system according to another exemplary embodiment of the present invention.

FIG. 2 schematically illustrates such a system 1000 according to another exemplary embodiment of the present invention. For example, the system 1000 may include the ECU 100, a power source 250, such as a battery, for powering the ECU 100 using supply and ground lines 83, a fuel tank 240 for storing a combustible fuel for the engine, a supply pump 230, a high pressure pump 210 provided with the fuel by the supply pump 230, and fuel distribution apparatus. The fuel distribution apparatus may include fuel injectors 221 configured to inject the fuel into the combustion engine (not shown), and a fuel rail 220 configured to provide the fuel from the high pressure pump 210 to the fuel injectors 221. The ECU 100 may be operatively connected to the high pressure pump 210 and the fuel injectors 221 via actuation lines 82 for adjusting the fuel distribution, i.e. the manner and timing of providing (or: injecting) the fuel to the combustion engine.

Referring again to FIG. 1, in particular the input interface 110 may be configured to receive at least one dynamic torque sensor value DTSV from the high pressure pump 210 of the vehicle; receive at least one additional sensor value ASV (for example from the fuel rail 220) including at least one pressure sensor value and/or at least one timing value and to receive combustion data indicating combustion properties of a current fuel type of a fuel currently present in the high pressure pump 210 and the fuel rail 220. Notably, sufficient data about the properties of any type of combustible fuel may be determined using the dynamic torque sensor value DTSV and the at least one additional sensor value ASV.

Figure 3:
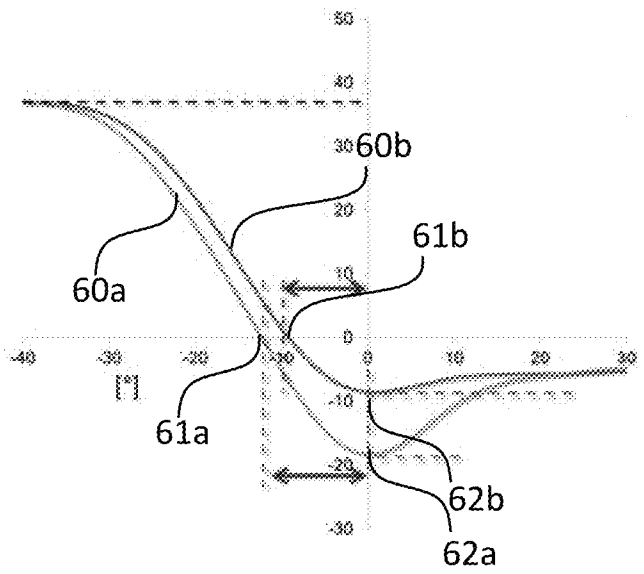
FIG. 3 schematically illustrates dynamic torque sensor values which may be used in exemplary embodiments of the present invention.

FIG. 3 schematically illustrates two such dynamic torque sensor values DTSV. FIG. 3 is a graph displaying on the horizontal axis an angle of the high pressure pump 210 in degrees, and on the vertical axis a drive torque in Newton-meters (Nm). Thus, FIG. 3 displays a dynamic drive torque waveform 60*a*, 60*b*, wherein in FIG. 3, "a" and "b" in reference signs refer to two different fuel types.

Characteristics of the high pressure pump 210 itself as well as fluid properties of the fuel are reflected in the physical appearance of drive torque, such that physical equilibriums in different stages become interpretable. The top dead center (TDC) point 61*a*, 61*b* clearly defines one position within the dynamic drive torque waveform 60*a*, 60*b* where the point where the dynamic drive torque waveform 60*a*, 60*b* switches from positive to negative values and can be assumed as a summation of rail pressure and spring force.

A second defining position is the negative peak 62*a*, 62*b* in the dynamic drive torque waveform 60*a*, 60*b*, in other words the value of the dynamic drive torque minimum. Under the assumption of not losing contact between tappet and roller to cam shaft of the high pressure pump 210, the impacting (or: effective) force is a summation of only the force by spring and fluid residual pressure:

$$F_{effective} = F_{Spring} + F_{Pressure} = \frac{T_{min}}{r_{(\delta)}}.$$

The force will be transferred as torque (diameter at cam position). In addition, the effective radius $r_{(\delta)}$ of the tappet when the tappet is at angular position δ determines the discharged displacement by considering the pump geometry of the high pressure pump 210 and using the radius $r_{based\ circle}$ of the tappet at its circular base:

$$r_{(\delta)} = f(\text{cam lift}) + r_{base\ circle}$$

The spring force $F_{Spring}$ on the pump cam shaft of the high pressure pump 210 can be determined, using a basic spring force $F_{Spring0}$ and a spring characteristic $c_{spring}$, as:

$$F_{Spring} = c_{spring} * (r_{(\delta)} - r_{base\ circle}) + F_{Spring0}$$

Based on these considerations, dynamic torque sensor values DTSVs which have been found to be well suited for determining fuel types are the values at the top dead center point (zero crossing of the dynamic drive torque waveform 60*a*, 60*b*) 61*a*, 61*b* and at the negative peak 62*a*, 62*b*. Referring to FIG. 2, these dynamic torque sensor values DTSVs may be provided by a drive torque sensor 213 operatively coupled to the high pressure pump 210. Preferably, a curve of such dynamic torque sensor values DTSVs measured at different rail pressure values $P_{rail}$ is provided by the drive torque sensor 213.

Referring back to FIG. 1 and FIG. 2, the additional sensor values ALVs may, for example, be provided via sensor lines 81 by the fuel rail 220 and/or by any part of the combustion engine. For example, additional sensor values ALVs may be provided by at least one rail pressure sensor 223 configured to measure a fuel pressure at the fuel rail 220, in particular at an end of the fuel rail 220 distal with respect to the high pressure pump 210.

To determine the speed of sound c of the fuel currently present in the vehicle (in particular: in the high pressure pump 210 and the fuel rail 220), for example two separate rail pressure sensors 223 may be used, or one rail pressure sensor 223 in combination with a timing sensor, the timing relating to a head valve closing of the high pressure pump 210, and/or the like.

Using the formula $$c = \sqrt{\frac{K}{\rho}} \rightarrow \rho = \frac{K}{c^2},$$

wherein c is the speed of sound of the fuel, and K is the bulk modulus describing compressibility of the fuel, the density ρ of the fuel can be determined.

Assuming that any residual amount of fuel at the TDC point has rail pressure $P_{rail}$, the bulk modulus K may be estimated as:

$$K = \frac{P_{rail} - P_{comp}}{V_{comp}} = \frac{P_{rail} - \dfrac{\dfrac{T_{min}}{r_{(\delta)}} - c_{spring} * (r_{(\delta)} - r_{basecrcle}) + F_{Spring0}}{A_{plunger}}}{r_{plunger}^2 * \pi * (l - r_{(\delta)})}$$

wherein the $P_{rail}$ a denotes a pressure in the fuel rail 220, and wherein "comp" denotes quantities in a state of compression by the high pressure pump 210. $T_{min}$ denotes the minimum 62*a*, 62*b* of the dynamic torque. Quantities with subscript "plunger" denote quantities associated with a plunger of the high pressure pump 210. In this way, the density ρ can be calculated accurately and with comparatively little effort. By analysis on altering rail pressure steps, e.g. about 200 bar to 1000 bar in 8 steps, fuel type and mixture characteristic profile may be determined.

Referring back to FIG. 1 and FIG. 2, the combustion data indicating the combustion properties of the current fuel type of the fuel currently present in the high pressure pump 210, fuel rail 220 and engine, may be provided by one or more cylinder pressure sensors 222 which measure corresponding pressures in cylinders of the combustion engine.

The computing device 150 of the ECU 100 implements a fuel type determination module FTDM, an artificial intelligence module AIM and a fuel distribution control module FDCM. The ECU may further include a database DB which may be part of the computing device 150, for example by being implemented on a memory unit of the computing device 150 or which may be implemented on a separate memory unit of the ECU 100. In particular, one database DB may be present per vehicle.

Alternatively, or even additionally, the input interface 110 may be configured to grant access to a database DB. For example, the database DB may be implemented as a cloud solution, i.e. may be stored and accessible on a cloud server. In particular, one database DB for a plurality of vehicles may be provided which may be accessed by any of the vehicles in a particular group (e.g., a group of vehicles that comprise the same hardware). A mixed implementation is also possible, wherein the database DB is principally realized as a cloud solution, but wherein the ECU 100 of each vehicle with access to said database DB further include an own database DB as well which stores the last known dataset of the cloud solution database as a backup. In the following, only one database DB will be mentioned for the further description of the invention but it should be kept in mind that this database DB may include more than one data repository, in local, remote or decentralized realizations without loss of generality.

The database DB contains at least information about known fuel types and a specific parameter configuration for the fuel rail 220 (e.g. for the fuel injectors 221) for each of the known fuel types. Such parameter configurations may, for example, include timings or amounts for fuel injections into one or more cylinders of the combustion engine. The fuel type determination module FTDM may be configured to determine, based on the at least one received dynamic torque sensor value DTSV and the received at least one additional sensor value ASV whether the current fuel type is of: a first fuel type group including the known fuel types; a second fuel type including fuel types within a predefined variation range about at least one fuel type of the first fuel type group; a third fuel type group including all other fuel types.

The next step then depends on which type of fuel type has been determined. In the following, possible optional subprocedures for each of the fuel type groups are described. It shall be understood that they may also be implemented independently from one another. In other words, in some exemplary embodiments, only the features described for the case of a fuel type of the first fuel type group, or only the features described for the case of a fuel type of the second fuel type group, or the features described for the case of a fuel type of the third fuel type group, may be implemented.

However, it is preferred that the features as described for all of the three cases in the following are implemented.

Figure 4:
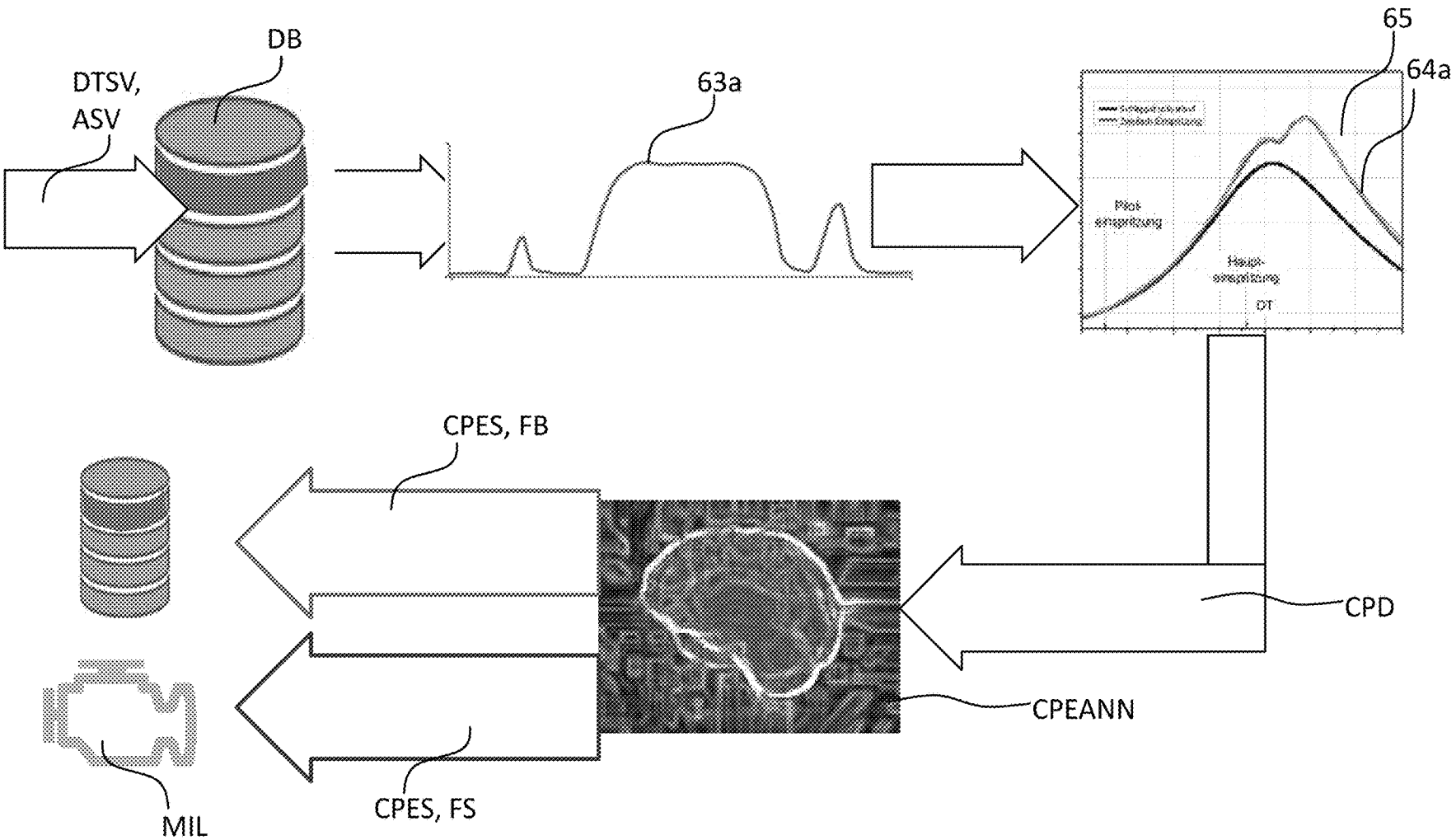
FIG. 4 shows a schematic flow of process steps for the case that the current fuel type is determined to be of the first fuel type group.

FIG. 4 shows a schematic flow of process steps for the case that the current fuel type is determined by the fuel type determining module FTDM to be of the first fuel type group. This case will be designated in the following shortly as the "first case". This first case relates to the detection of a known fuel type.

In this first case, the fuel distribution control module FDCM may be configured to generate control signals CTRL for the fuel injectors 221 connected to the fuel rail 220 using the specific parameter configuration for the current fuel type from the database DB. In FIG. 4 it is schematically illustrated that the control signals CTRL are output directly by the database DB. While this is possible, in reality other software modules may be interposed, in particular if calculations have to be performed to generate the control signals CTRL based on the specific parameter configurations contained in the database DB. Similarly, although in FIG. 4 schematically the sensor values DTSV and ASV are shown to be directly entering the database, it shall be understood that this simply indicates that these sensor values DTSV and ASV are, as has been described in the foregoing, essential for determining the fuel type group of the current fuel, as well as the selected fuel (which determines the specific parameter configuration on which the control signals CTRL are based).

Based on, or using, the control signals CTRL, the fuel injectors 221 may be operated to inject the current fuel into corresponding cylinders of the combustion engine according to an injection waveform 63*a* as schematically also illustrated in FIG. 4, wherein the vertical axis depicts injection amount and the horizontal axis depicts time. The control signals CTRL may be output by the output interface 190 for transmission to the fuel injectors 221 via actuator lines 82. Then, combustion is performed which may be represented by a combustion waveform 64*a*. The combustion waveform 64*a* may lie within a (generally multi-dimensional) corridor 65 of acceptable combustion performance parameters or (completely, or more commonly, partially) outside of said corridor 65.

Since the first case describes the case that a known fuel type (i.e. of the first fuel type group) is used, and since specific parameter configuration for that fuel type are stored in the database, it is expected that the combustion of this fuel type using said specific parameter configurations results in an ideal combustion performance. If this is not the case, a problem with one or more components of the vehicle, or the engine in particular, may be present.

For that reason, the artificial intelligence module AIM may be configured to implement a combustion performance evaluation artificial intelligence entity. This entity may use any known artificial intelligence technique such as K-means or a support vector machine. Herein, specifically a combustion performance evaluation artificial neural network, CPEANN, is used for this purpose.

This CPEANN is trained to receive the combustion performance data CPD (e.g. from at least one cylinder pressure sensor 222 ) via the sensor lines 83 and the input interface 110 as its input, and to output as its output a combustion performance evaluation signal CPES. This combustion performance evaluation signal CPES may be (or may comprise) a fault signal FS which may indicate a hardware defect, or engine fault, to an on-board diagnosis (OBD) system of the vehicle and/or to a bus system of the vehicle, e.g. to a CAN bus. This may lead to a malfunction indication light MIL being activated in the vehicle.

The CPEANN is trained for determining, based on the combustion performance data, CPD, whether the combustion performance evaluation signal CPES should be a fault signal FS or not. If not, in some exemplary embodiments the CPEANN may be configured to output a feedback signal FB which may, for example, confirm to the database DB that the specific parameter configuration for the known fuel type results in the desired ideal combustion performance. This option may be particularly desirable when a cloud-based database DB is used which will thus receive such feedback signals FB from a plurality of vehicles. This may help to further improve the understanding of the properties of the different fuels. Similarly, in case that the combustion performance evaluation signal, CPES, is a fault signal FS, also said fault signal may be transmitted to the database DB (in particular a cloud-based databased DB).

Figure 5:
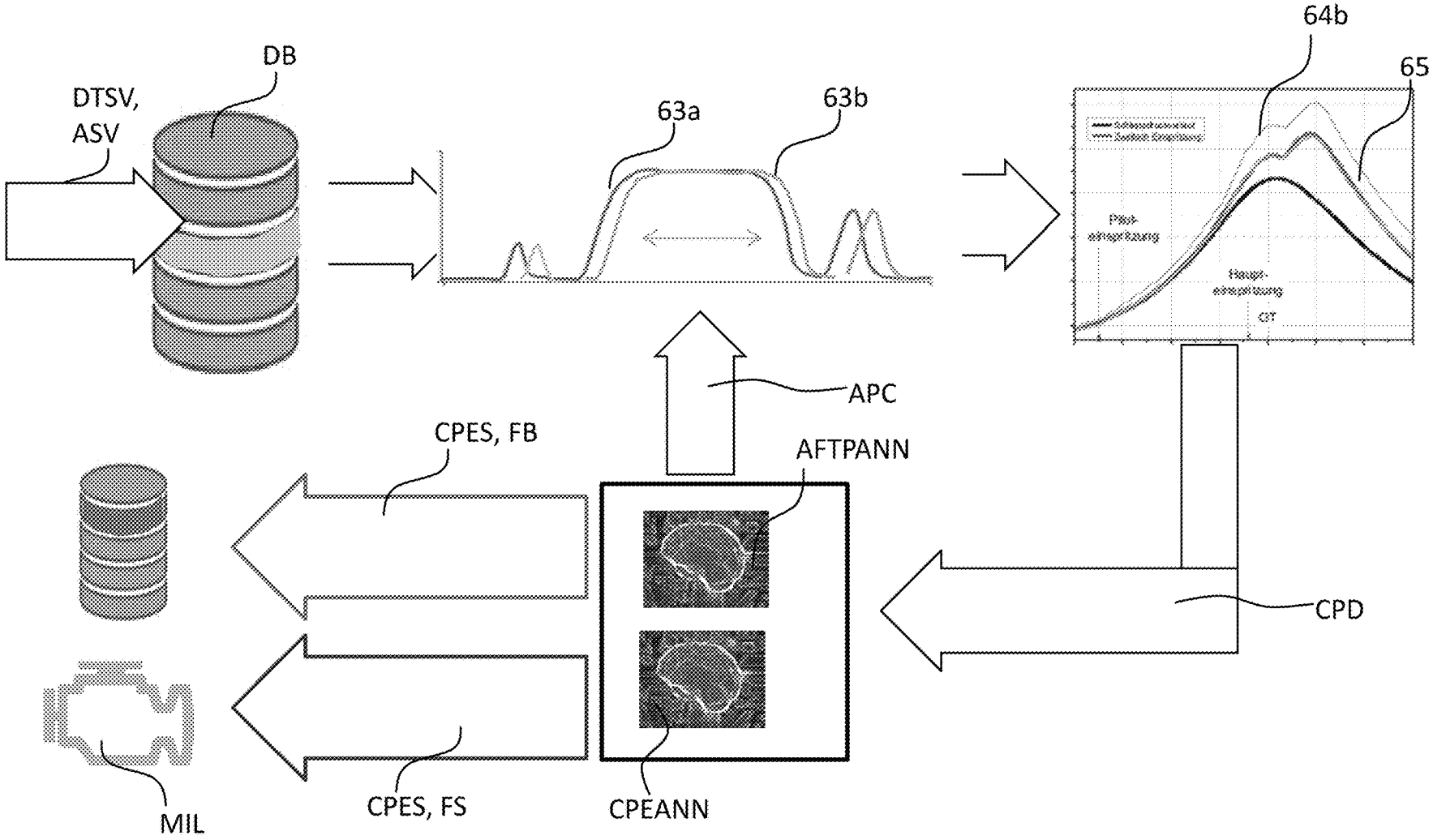
FIG. 5 shows a schematic flow of process steps for the case that the current fuel type is determined to be of the second fuel type group.

FIG. 5 shows a schematic flow of process steps for the case that the current fuel type is determined by the fuel type determining module FTDM to be of the second fuel type group. This case will be designated in the following shortly as the "second case". This second case relates to the detection of a fuel type which is "almost known", i.e. which is similar (according to a predefined similarity metric as described in the foregoing) to a known fuel type. In this sense, the second case may also be referred to as a "borderline case", since the fuel type may be said to be on the border between known and unknown fuel types. As a reminder, this may be the case when a normally known fuel type is provided with a lower quality than usual, or is contaminated, or augmented, with another substance.

Secondly, when the current fuel type is determined to be of the second fuel type group, the fuel injection control module FICM may be configured to select a fuel type of the first fuel type group from the database DB based on the at least one received dynamic torque sensor value DTSV and the received at least one additional sensor value ASV. The selected fuel type may be a fuel type which is most similar to the current fuel type in on or more properties. These properties may, for example, be directly sensor values such as the dynamic torque sensor value DTSV and/or the at least one additional sensor value ASV. The properties may alternatively, or in addition, also be properties derived from sensor values such as a bulk modulus, a speed of sound, a density and/or the like of the current fuel type.

If more than one property is compared between the current fuel type and the fuel types of the first fuel type group, then each property may be equally weighted, or different weights may be applied to different properties. The selected fuel type may also be selected from the fuel types of the first fuel type group following IF-THEN type rules and/or decision trees or the like.

Further, describing the case that the current fuel type is determined to be of the second fuel type group, the fuel injection control module FICM may further be configured to initially generate the control signals for the fuel injectors 221 using (or: based on) the specific parameter configuration for the selected fuel type from the database. In other words, the known fuel type most similar to the current fuel type may be determined and selected (selected fuel type), and then the specific parameter configurations for that selected fuel type are used for the initial operation of the combustion engine with the current fuel type.

These rules, weights, and in general selection strategies for selecting the selected fuel type may, in general, be selected and devised to ensure, or at least make more likely, that the specific parameter configurations used for the current fuel type result in a combustion within the desired corridor 65. As is schematically shown in FIG. 5, a combustion waveform 64*b* of the current fuel type may be slightly shifted or skewed with respect to the desired corridor 65.

The artificial intelligence module AIM running on the computing device 150 is further configured to implement an adapted fuel type parameter artificial intelligence entity, in particular an adapted fuel type parameter artificial neural network AFTPANN. The adapted fuel type parameter artificial neural network AFTPANN is configured and trained to receive the combustion performance data CPD and to output, based thereon, an adapted parameter configuration APC. The fuel injection control module FICM may be configured to generate, after a predefined initial period, the control signals for the fuel injectors 221 based on the adapted parameter configuration APC.

The AIM may be configured to start with pre-set values for the adapted fuel type parameter artificial neural network AFTPANN and to train the adapted fuel type parameter artificial neural network AFTPANN, preferably using reinforcement learning, based on the combustion performance data CPD. As the pre-set initial parameters (e.g. weights and biases) for the AFTPANN, stored parameters for a fuel type parameter artificial neural network, FTPANN, for the selected fuel type (i.e. the known fuel type to which the current fuel type is most similar) may be used. In other words, for each known fuel type, which is each fuel type within the first fuel type group, a set of parameters for a corresponding FTPANN may be stored for the purpose of being used as initial parameters for an AFTPANN for which the respective known fuel type is selected as most similar.

In the reinforcement learning, parameter settings (or changes) of the adapted fuel type parameter artificial neural network AFTPANN are rewarded which result in the combustion waveform 64*b* of the current fuel coming closer to, or being located more towards the center of, the desired corridor 65, and conversely, parameter settings (or changes) of the adapted fuel type parameter artificial neural network AFTPANN are penalized which result in the combustion waveform 64*b* of the current fuel moving away from the desired corridor 65. As a result of the reinforcement training (or: reinforcement learning), the injection waveform 63*a* used initially may be adapted to an adapted waveform 63*b* for the current fuel type as shown in FIG. 5. The artificial intelligence module AIM may be configured such that reinforcement learning is be stopped when a predetermined stopping condition has been reached, e.g. a desired congruity of the combustion waveform 64*b* with the desired corridor 65 (e.g. the entire combustion waveform 64*b* must be inside the desired corridor 65), or a deviation of the combustion waveform 64*b* from a center curve of the desired corridor 65 below a predefined threshold according to a deviation metric (e.g. squared error metric).

After the training of the adapted fuel type parameter artificial neural network AFTPANN has been stopped, the output of the adapted fuel type parameter artificial neural network AFTPANN is provided as a new specific parameter configuration for the current fuel type to the fuel injection control module, FICM, and may also be stored as such within the database DB. Moreover, the adapted fuel type parameter artificial neural network AFTPANN in the condition in which training has been stopped (i.e. sufficiently trained) may be saved within the database DB as the corresponding fuel type parameter artificial neural network FTPANN for the current fuel type.

With this, the current fuel type becomes part of the first fuel type group. This indicates that if the same fuel type continues to be present in the fuel tank 240, or if the same fuel type is at a later date again inserted into the fuel tank 240, this same fuel type will be treated as a known fuel type, and the corresponding specific parameter configuration will be used by the fuel injection control module FICM for generating the control signals for the fuel injectors 221. Similarly, if then another fuel type is injected into the fuel tank 240 which is not the same fuel type but similar, the stored specific parameter set and the parameters of the trained adapted fuel type parameter artificial neural network AFTPANN may be used to perform the procedure of FIG. 5 for the most recent fuel type, and so on.

Additionally, in the second case, the combustion performance evaluation artificial neural network CPEANN implemented by the artificial intelligence module AIM may be employed to provide the combustion performance evaluation signal CPES as described in the foregoing. The combustion performance evaluation artificial neural network CPEANN may be deactivated for the predefined training time in order to avoid fault signals FS being output during the training. There may be one combustion performance evaluation artificial neural network CPEANN for all fuel types, or there may be one combustion performance evaluation artificial neural network CPEANN per known fuel type of the first fuel type group.

In the latter case, just as has been described with respect to the adapted fuel type parameter artificial neural network AFTPANN, the combustion performance evaluation artificial neural network CPEANN for the selected fuel type of the first fuel type group (being the known fuel type most similar to a current unknown fuel type of the second fuel type group) may be used as the basis and may be trained to be optimized for the current fuel type.

Alternatively, or additionally, the combustion performance evaluation artificial neural network CPEANN may also be provided, or downloaded, from a cloud storage. For example, in case of any malfunctions, a dataset indicating (at least) the current fuel type, the combustion performance data and the type of malfunction may be generated and transmitted to the cloud storage. A plurality of such datasets may then be used to train, or further train, a combustion performance evaluation artificial neural network CPEANN for the corresponding fuel type. In this context, it should be understood that the fuel type may be identified by a coded identifier or by any other means, for example by its characteristic dynamic values, i.e. its dynamic torque sensor value DTSV and/or the at least one additional sensor value(s) ASV.

Figure 6:
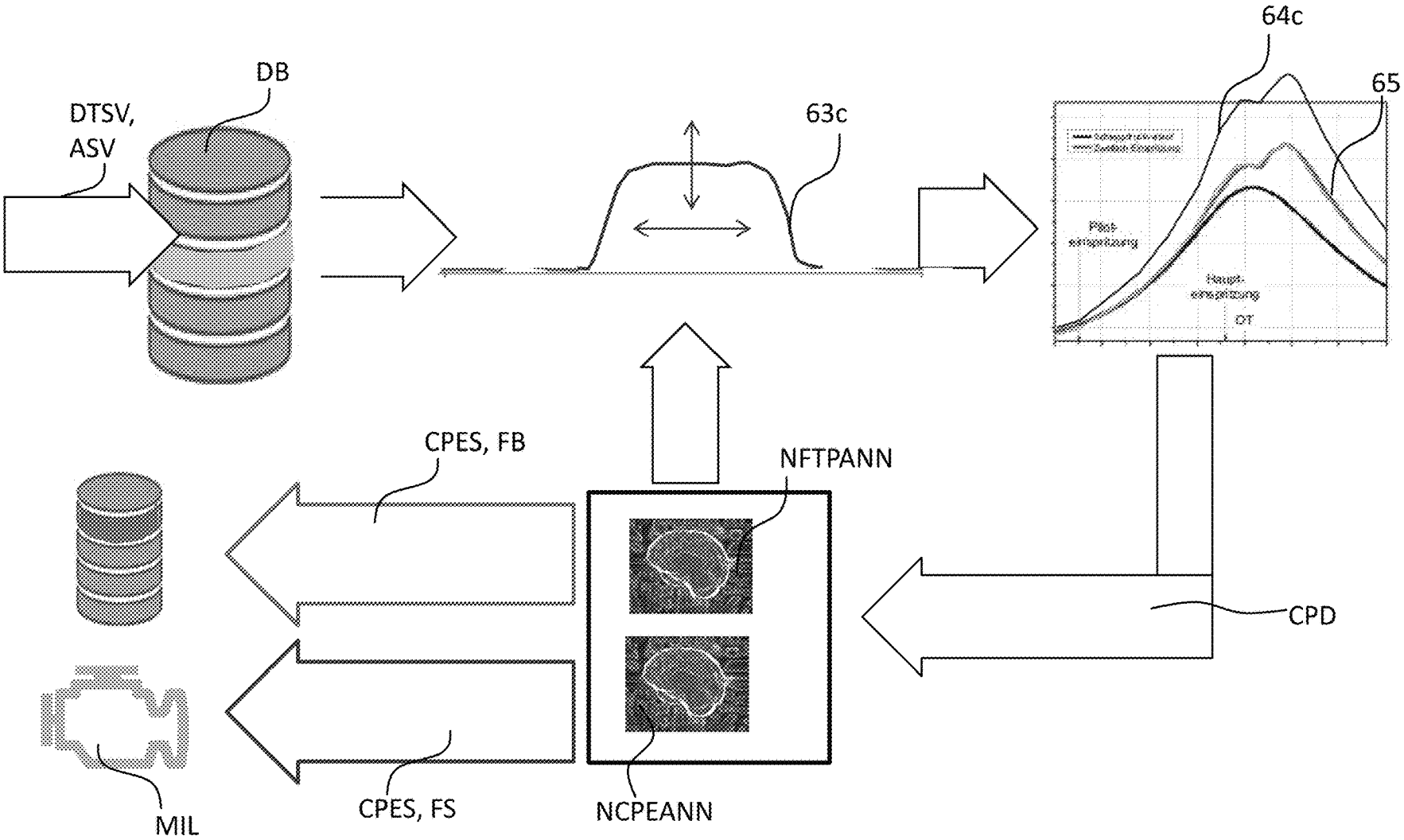
FIG. 6 shows a schematic flow of process steps for the case that the current fuel type is determined to be of the third fuel type group.

FIG. 6 shows a schematic flow of process related to when the current fuel type is determined by the fuel type determining module FTDM to be of the third fuel type group. This means that the current fuel type is neither explicitly known (first fuel type group), nor within predefined parameter ranges of (i.e. sufficiently similar to) one of the known fuel types. In other words, the third fuel type group includes all currently unknown fuel types. This case will also be designated as the "third case" in the following.

In this third case, there is no specific parameter configuration of a fuel type of the first fuel type which may be used for initial control of the fuel injectors 221. Therefore, in the third case, the fuel injection control module FICM may be configured to generate control signals for the fuel injectors 221 initially using a fallback parameter configuration result in a fallback injection waveform 63*c* as illustrated in FIG. 6.

The fallback parameter configuration may be chosen such that it leads in all (or at least the majority, preferably the overwhelming majority) of fuel types to a stable combustion that is not harmful to the combustion engine. As an option, a suitability check may be performed: in case that the dynamic torque sensor value DTSV and/or the at least one additional sensor value ASV indicate that this will currently not be the case, then instead the whole procedure may be stopped and a warning signal may be output to the on-board diagnosis (OBD) system, for example a message indicating "unsuitable fuel type" or the like. Thus, in some exemplary embodiments, prior to the determination of the fuel type group, or after the fuel type is determined to be of the third fuel type group, the above suitability check may be performed. If the suitability check fails, warning signal may be output by the output interface 190, and in response to determining that the suitability check passes, the procedure is continued as described.

As is illustrated in FIG. 6, the fallback injection waveform 63*c* may cause a combustion waveform 64*c* for the current fuel type to be outside the desired corridor for a significant portion of it. In some exemplary embodiments, the suitability check may be performed based on the initial combustion performance data CPD resulting from the combustion of the current fuel using the fallback injection waveform 63*c*. When no suitability check is performed, or when the suitability check is passed, then the artificial intelligence module AIM may be configured to implement and train a new fuel type parameter artificial neural network NFTPANN for determining a specific parameter configuration for the current fuel type.

The AIM may be configured to train the new fuel type parameter artificial neural network NFTPANN using reinforcement learning based on the received combustion data, as has been described in the foregoing with respect to the adapted fuel type parameter artificial neural network AFTPANN in the second case. The fuel injection control module FICM may be configured to generate the control signals for the fuel injectors 221 based on an output of the new fuel type parameter artificial neural network NFTPANN during training of the NFTPANN to close the feedback loop and the adapted fuel type parameter artificial neural network AFTPANN may be configured to, via reinforcement learning, learn from the changes in the combustion waveform 64*c* resulting indirectly from its own output.

Again, the artificial intelligence module AIM may be configured to stop the training of the NFTPANN when a stopping condition is fulfilled. Thereafter, the specific parameter configuration for the current fuel type of the third fuel type group may be set based on the output of the trained NFTPANN, and the current fuel type is added to the first fuel type group. Similar to what has been described with respect to the second case, this means that after this process is stopped, the current fuel type, being originally of the third fuel type group, may be placed within the first fuel type group as well, with all corresponding data (specific configuration parameters, parameters of the corresponding new fuel type parameter artificial neural network NFTPANN, and so on) being stored in the database DB for further use.

In this sense, the procedures in the second case and in the third case are quite similar regarding the fuel type parameter artificial neural network FTPANN, with the main (or only) difference that the second case, the training of the adapted fuel type parameter artificial neural network AFTPANN starts with pre-trained neural network parameters based on the selected fuel type (i.e. the most similar known fuel type), whereas in the third case the training of the new fuel type parameter artificial neural network NFTPANN starts with pre-trained fallback neural network parameters which are the same for every fuel type determined to be of the third fuel type group.

If a cloud server is used to implement a central database DB for a plurality of vehicles, then each occurrence of the second case and the third case may prompt a completely new entry within the central database, i.e. an addition of a fuel type of the first fuel type group (with the corresponding data) within the central database. Thus, over time, the first case will become more and more prevalent. The artificial intelligence module AIM configured to implement, and optionally train, a new combustion performance evaluation artificial neural network NCPEANN for determining whether the operation of the combustion engine using the current fuel type and using the control signals based on the output of the NFTPANN is acceptable.

When a new combustion performance evaluation artificial neural network NCPEANN is trained, the artificial intelligence module AIM may be further configured to replace the previous combustion performance evaluation artificial neural network CPEANN with the new combustion performance evaluation artificial neural network NCPEANN while the current fuel type of the third fuel type group is used when a replacement condition is fulfilled. In some exemplary embodiments, the replacement condition may be constantly fulfilled. In other exemplary embodiments, the replacement condition may be fulfilled only if a test of the trained new combustion performance evaluation artificial neural network NCPEANN is successful, for example correct outputs of the new combustion performance evaluation artificial neural network NCPEANN to a series of simulated input datasets with known correct outputs, or, as another example, an accuracy of the new combustion performance evaluation artificial neural network NCPEANN below a predefined threshold.

In other exemplary embodiments or variants, due to the unknown nature of the fuel types of the third fuel type group, the function of the combustion performance evaluation artificial neural network CPEANN may be deactivated while said fuel type is present in the fuel system of the vehicle.

Both in the second case and in the third case, for the training of the fuel type parameter artificial neural network FTPANN (either adapted fuel type parameter artificial neural network AFTPANN or new fuel type parameter artificial neural network NFTPANN), in addition to the combustion performance data CPD, also determined properties of the fuel type itself may be used as input. For example, the dynamic torque sensor value DTSV and/or the at least one additional sensor value ASV may be used as additional input. Alternatively, or additionally, calculated or derived properties of the current fuel type may be used as additional input, for example a density of the fuel type, a speed of sound of the fuel type, a bulk modulus of the fuel type, all of which may preferably be calculated based on the dynamic torque sensor value DTSV and/or the at least one additional sensor value ASV.

When the vehicle is provided with a positioning system such as a global positioning system (GPS) device or the like, then information about fuel types may be provided to a cloud-based central database with a location stamp (and preferably also with a time stamp). Since each vehicle using the described method may be seen as a testing station for types of fuel, the corresponding data may be advantageously collected in the cloud based central database for further analysis. Such data may, for example, include specific parameter sets, the dynamic torque sensor values DTSV, the additional sensor values ASV, the combustion performance evaluation signals CPES, the combustion waveforms 64*a*, 64*b*, 64*c*, the neural network parameters of any of the artificial neural networks described herein, or any other type of data described herein as being generated or calculated.

Analysis of such data fields may yield, for example, information about a certain region providing fuel of a lesser quality than expected, the distribution of a particular type of fuel, seasonal and/or other temporal variations in the quality and/or properties of fuel types and so on. Such data may then be used to further refine the method itself, for example for refining the rules used for determining, in the second case, the most similar known fuel type. For instance, some temperature-based seasonal changes of properties of fuel types may be factored into the selection of the known fuel type most like to provide a good initial specific parameter configuration.

Information about regional and/or seasonal fuel quality may also be fed back by the cloud service to, for example, a navigation system of the vehicle. When the vehicle driver requests information about the next fuel station, this type of information may be considered when the navigation system provides a list of choices to the driver. The navigation system may also provide the driver with a choice of filtering options, such as "nearest fuel station", "fuel station with lowest fuel price" and, based on said data, "fuel station with best fuel quality", or a combination thereof.

Figure 7:
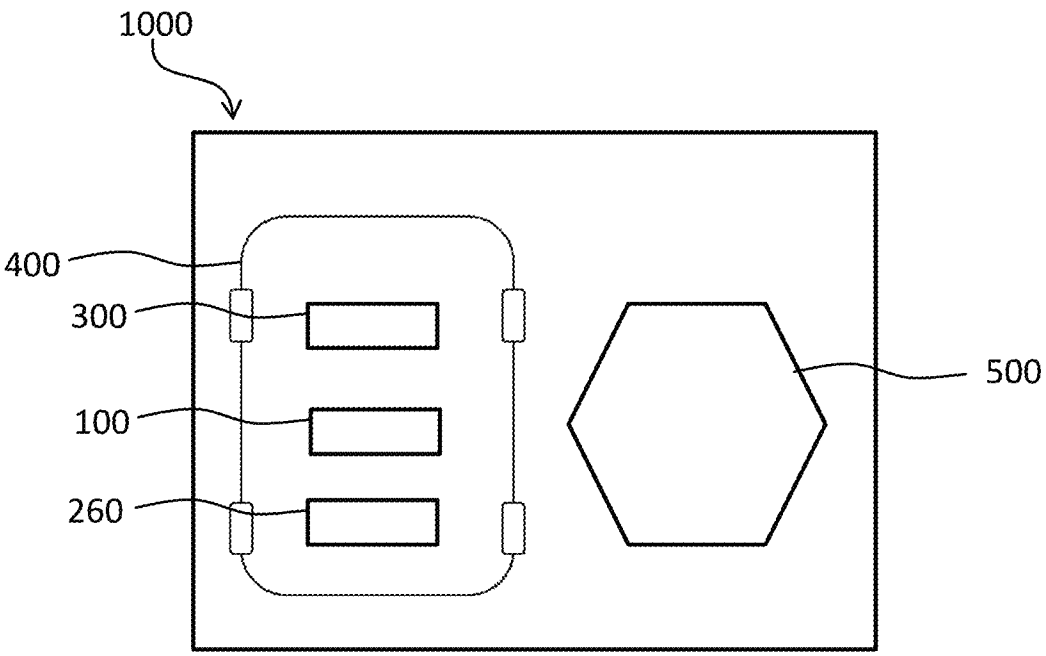
FIG. 7 schematically illustrates further apparatus and methods provided by the present invention.

FIG. 7 schematically illustrates further apparatus and methods provided by the present invention. According to the invention, also a system 1000 for providing services to vehicles is provided, including a cloud computing device 500 configured to receive data uploads from the ECUs 100 of a plurality of vehicles 400. The cloud computing device 500 may be configured to analyze the data uploads, which may include any of the data types or data type combinations described herein, and to provide data updates to the individual ECUs 100 and/or to the vehicles 400 including combustion engines 260 and those individual ECUs 100.

As has been described in the foregoing, such data updates may include navigation data updates for navigation systems 300 of the vehicles, updates of local databases DB of the vehicles 400 with additional known fuel types and corresponding information (such as specific parameter configurations, artificial neural network parameters for use in the second case as described with respect to FIG. 5 etc.) and/or the like. It shall be understood that in FIG. 2 the various other components of the vehicle 400 such any of the elements in FIG. 2 may be present but are not shown.

Figure 8:
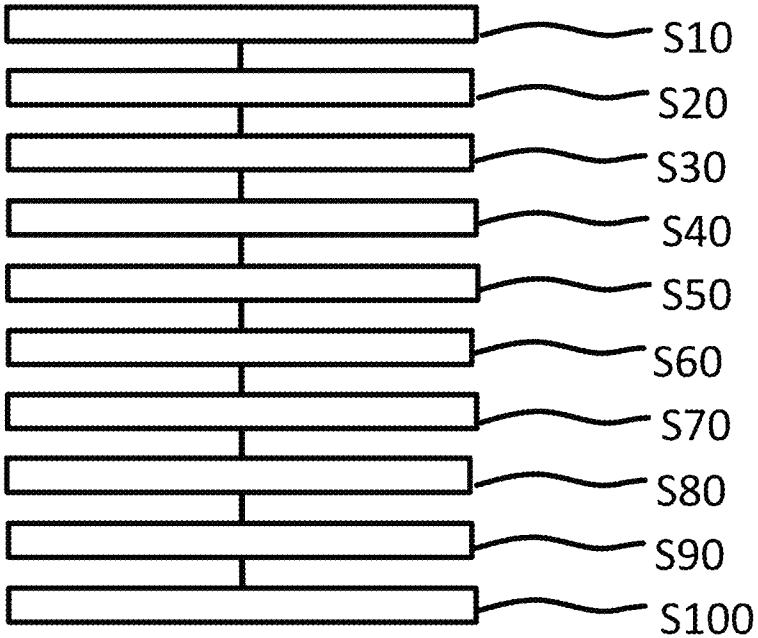
FIG. 8 schematically illustrates a method for fuel analysis according to another embodiment of the present invention as well as a method for operating a vehicle with a combustion engine according to yet another exemplary embodiment of the present invention.

FIG. 8 schematically illustrates a method for fuel analysis according to another exemplary embodiment of the present invention. In order to keep repetitions down to a minimum, for the description of this method, it is referred back to the detailed description of the ECU 100 as described with respect to FIG. 2 through FIG. 7, and to FIG. 2 through FIG. 7 themselves.

In a step S10, at least one dynamic torque sensor value DTSV from a high pressure pump 210 of the vehicle 400 is received, in particular by an ECU 100 (more precisely: an input interface 110 of the ECU 100) as has been described in the foregoing. In a step S20, at least one additional sensor value ASV may be received at the ECU 100 from a fuel rail 220 of the vehicle 400, the at least one additional sensor value ASV including at least one pressure sensor value and/or at least one timing value as has been described in the foregoing.

In a step S30, combustion performance data CPD indicating combustion properties of a current fuel type of a fuel currently present in the high pressure pump 210 and the fuel rail 220 and being currently provided to the combustion engine 260 may be received at the ECU 100 as has been described in the foregoing. In a step S40, it may be determined, as has been described in the foregoing, based on the at least one received DTSV and on the received at least one ASV and using a database DB containing information about known fuel types, whether the current fuel type is of: a first fuel type group including the known fuel types; a second fuel type including fuel types within a predefined variation range about at least one fuel type of the first fuel type group; or a third fuel type group including all other fuel types.

The method may include further optional steps S50 through S100, in which case the method may also be designated as a method for operating a combustion engine 260 of a vehicle 400. Specifically, the method may include a step S50 of generating, in case the current fuel type is determined by the fuel type determination module FTDM to be of the first fuel type group (i.e. a fuel type known in the database DB), control signals for fuel injectors 221 of the vehicle 400 using a specific parameter configuration for the current fuel type from the database DB, as has been described in the foregoing.

The method may further include, in case the current fuel type is determined by the fuel type determination module FDTM to be of the second fuel type group: selecting S60 a fuel type of the first fuel type group from the database DB based on the at least one received dynamic torque sensor value DTSV and on the received at least one additional sensor value ASV, as has been described in the foregoing; and generating S70 the control signals using the specific parameter configuration for the selected fuel type from the database DB, as has been described in the foregoing.

The method may further include, in case the current fuel type is determined by the fuel type determination module FDTM to be of the third fuel type group: generating S80 the control signals for the fuel injectors 221 initially using a fallback parameter configuration, as has been described in the foregoing; and implementing S90 and training S100 a new fuel type parameter artificial neural network NFTPANN for determining a specific parameter configuration for the current fuel type, as has been described in the foregoing.

It shall be understood that any or all variants, refinements, or options, that have been described in the foregoing with respect to any of the exemplary embodiments of the methods according to the present invention, of the electronic control unit 100 or of the system 1000 may also be made part of the method described herein.

One basic principle of the current invention may be summarized as follows: at least one dynamic torque sensor value DTSV from a high pressure pump 210 of a vehicle 400 and at least one additional sensor value ASV including at least one pressure sensor value and/or at least one timing value are used to determine whether a combustible fuel type currently in use in the vehicle is known, unknown, or similar to a known fuel type. In each case, the invention provides procedures for optimizing the operation of the combustion engine 260 by using specific parameter configurations for the fuel injectors 221 of the vehicle 400. The specific parameter configurations are either retrieved from a database DB, or are generated using artificial intelligence methods.

The invention has been described in detail referring to exemplary embodiments. However, it will be appreciated by those of ordinary skill in the art that modifications to these embodiments may be made without deviating from the principles and central ideas of the invention, the scope of the invention defined in the claims, and equivalents thereto.

REFERENCE LIST

60*a* dynamic drive torque waveform
60*b* dynamic drive torque waveform
61*a* top dead center point
61*b* top dead center point
62*a* negative peak
62*b* negative peak
63*a* injection waveform
63*b* injection waveform
63*c* injection waveform
64*a* combustion waveform
64*b* combustion waveform
64*c* combustion waveform
65 desired corridor
100 electronic control unit
110 input interface
150 computing unit
190 output interface
210 high pressure pump
213 drive torque sensor
220 fuel rail
221 fuel injectors
222 cylinder pressure sensor
223 rail pressure sensor
230 supply pump
240 fuel tank
250 power source
260 combustion engine
300 navigation system
400 vehicle
500 cloud computing device
1000 system
AFTPANN adapted fuel type parameter artificial neural network
APC adapted parameter configuration
ASV additional sensor value
DB database
DTSV dynamic torque sensor value
CPD combustion performance data
CPEANN combustion performance evaluation artificial neural network
CPES combustion performance evaluation signal
FB feedback signal
FS fault signal
MIL malfunction indicator lamp
NCPEANN new combustion performance evaluation artificial neural network
NFTPANN new fuel type parameter artificial neural network
S10 . . . S100 method steps

What is claimed is:

1. An electronic control unit, ECU, for a vehicle with a combustion engine, comprising:
an input interface configured to:
receive at least one dynamic torque sensor value (DTSV) from a high pressure pump of the vehicle;
receive at least one additional sensor value (ASV) including at least one pressure sensor value or at least one timing value;
receive combustion performance data (CPD) indicating combustion properties of a current fuel type of a fuel currently present in the high pressure pump and a fuel rail; and
grant access to a database (DB) containing:
information about known fuel types; and
a specific parameter configuration for fuel injectors operatively connected to the fuel rail, for each of the known fuel types;
a computing unit including:
a fuel type detection module (FTDM);
an artificial intelligence module (AIM); and
a fuel injection control module (FICM);
wherein the fuel type detection module (FTDM) is configured to determine, based on the at least one received dynamic torque sensor value (DTSV) and the received at least one additional sensor value (ASV) whether the current fuel type is of:
a first fuel type group including the known fuel types;
a second fuel type group including fuel types within a predefined variation range about at least one fuel type of the first fuel type group;
a third fuel type group including all other fuel types;
wherein, in response to determining that the current fuel type is the first fuel type group:
the fuel injection control module (FICM) is configured to generate control signals for the fuel injectors using the specific parameter configuration for the current fuel type from the database;
wherein, in response to determining that the current fuel type is the third fuel type group:
the fuel injection control module (FICM) is configured to generate control signals for the fuel injectors initially using a fallback parameter configuration; and
the AIM is configured to implement and train a new fuel type parameter artificial neural network (NFTPANN) for determining a specific parameter configuration for the current fuel type.

2. The ECU of claim 1, wherein the artificial intelligence module (AIM) is further configured to:
implement a combustion performance evaluation artificial neural network, CPEANN, configured to receive at least the combustion performance data (CPD) and to determine, based at least thereon, whether the operation of the combustion engine is currently acceptable in view of the current fuel type,
wherein the electronic control unit (ECU) further includes an output interface configured to provide a combustion performance evaluation signal, CPES, based on the output of the combustion performance evaluation artificial neural network, CPEANN.

3. The ECU of claim 2, wherein
the artificial intelligence module (AIM) is further configured to implement and train a new combustion performance evaluation artificial neural network (NCPEANN) for determining whether the operation of the combustion engine using the current fuel type and using the control signals based on the output of the new fuel type parameter artificial neural network (NFTPANN) is acceptable, and
the artificial intelligence module (AIM) is configured to replace the previous combustion performance evaluation artificial neural network (CPEANN) with the new combustion performance evaluation artificial neural network (NCPEANN) while the current fuel type of the third fuel type group is used when a replacement condition is fulfilled.

4. The ECU of claim 1, wherein in response to determining that the current fuel type is the third fuel type group:
the artificial intelligence module (AIM) is configured to train the new fuel type parameter artificial neural network (NFTPANN) using reinforcement learning based on the received combustion performance data (CPD); and the fuel injection control module (FICM) is configured to generate the control signals based on an output of the new fuel type parameter artificial neural network (NFTPANN) during its training.

5. The ECU of claim 4, wherein the artificial intelligence module (AIM) is configured to:

stop the training of the new fuel type parameter artificial neural network (NFTPANN) when a stopping condition is fulfilled and wherein thereafter the specific parameter configuration for the current fuel type of the third fuel type group is set based on the output of the trained new fuel type parameter artificial neural network (NFTPANN), and the current fuel type is added to the first fuel type group.

6. The ECU of claim 1, wherein in response to determining that the current fuel type is the second fuel type group, the fuel injection control module (FICM) is configured to:

select a fuel type of the first fuel type group from the database based on the at least one received dynamic torque sensor value (DTSV) and on the received at least one additional sensor value (ASV); and generate the control signals using the specific parameter configuration for the selected fuel type from the database (DB).

7. The ECU of claim 6, wherein the artificial intelligence module (AIM) is further configured to:

implement and train an adapted fuel type parameter artificial neural network (AFTPANN) for determining a specific parameter configuration for the current fuel type, wherein initial parameters of the adapted fuel type parameter artificial neural network (AFTPANN) to be trained are taken from a database entry of the database (DB) associated with the selected fuel type.

8. The ECU of claim 7, wherein the database (DB) includes parameters for a corresponding pre-trained fuel type parameter artificial neural network for each of the fuel types of the first fuel type group, and wherein the initial parameters for the adapted fuel type parameter artificial neural network (AFTPANN) to be trained are the parameters of the pre-trained fuel type artificial neural network of the selected fuel type.

9. A vehicle comprising an electronic control unit (ECU) according to claim 1, and further comprising the combustion engine, the high pressure pump, and the fuel rail.

10. A method for fuel type analysis, comprising:

receiving, by a controller, at least one dynamic torque sensor value (DTSV) from a high pressure pump of a vehicle;

receiving, by the controller, at least one additional sensor value (ASV) from a fuel rail of the vehicle, the at least one additional sensor value (ASV) including at least one pressure sensor value or at least one timing value;

receiving, by the controller, combustion performance data (CPD) indicating combustion properties of a current fuel type of a fuel currently present in the high pressure pump and the fuel rail and being currently provided to a combustion engine of the vehicle;

determining, by the controller, based on the at least one received dynamic torque sensor value (DTSV) and the received at least one additional sensor value (ASV) and using a database (DB) containing information about known fuel types, whether the current fuel type is of:

a first fuel type group including the known fuel types;

a second fuel type group including fuel types within a predefined variation range about at least one fuel type of the first fuel type group;

a third fuel type group including all other fuel types.

11. A method for operating a combustion engine of a vehicle, comprising:

determining, by the controller, whether the current fuel type of the fuel currently present in the high pressure pump of the vehicle and the fuel rail of the vehicle and being currently provided to the combustion engine is of the first fuel type group, the second fuel type group or the third fuel type group according to claim 10;

wherein, in response to determining that the current fuel type is the first fuel type group, the method includes:

generating, by the controller, control signals for fuel injectors of the vehicle using a specific parameter configuration for the current fuel type from the database; and wherein, in response to determining that the current fuel type is the third fuel type group, the method includes:

generating, by the controller, the control signals for the fuel injectors initially using a fallback parameter configuration; and implementing and training, by the controller, a new fuel type parameter artificial neural network (NFTPANN) for determining a specific parameter configuration for the current fuel type.

* * * * *